US008265228B2

(12) United States Patent
Shaw et al.

(10) Patent No.: US 8,265,228 B2
(45) Date of Patent: Sep. 11, 2012

(54) ANTI-SCATTER X-RAY GRID DEVICE AND METHOD OF MAKING SAME

(75) Inventors: Jeffrey Jon Shaw, Ballston Lake, NY (US); Kevin Matthew Durocher, Waterford, NY (US)

(73) Assignee: General Electric Company, Niskayuna, NY (US)

( * ) Notice: Subject to any disclaimer, the term of this patent is extended or adjusted under 35 U.S.C. 154(b) by 263 days.

(21) Appl. No.: 12/824,811

(22) Filed: Jun. 28, 2010

(65) Prior Publication Data

US 2011/0317819 A1 Dec. 29, 2011

(51) Int. Cl.
*G21K 1/00* (2006.01)

(52) U.S. Cl. ..... 378/154

(58) Field of Classification Search ..... 378/149, 378/154; 427/160
See application file for complete search history.

(56) References Cited

U.S. PATENT DOCUMENTS 5,418,833 A 5/1995 Logan
5,557,650 A 9/1996 Guida et al.
5,581,592 A * 12/1996 Zarnoch et al. ..... 378/154
6,625,253 B1 9/2003 Barnes et al.
6,733,266 B1 5/2004 Guida et al.
6,980,629 B1 12/2005 Hoheisel et al.
7,180,982 B2 2/2007 Schneider et al.
7,256,402 B1 8/2007 Lee
7,411,204 B2 8/2008 Appleby et al.
7,463,712 B2 12/2008 Zhu et al.
7,518,136 B2 4/2009 Appleby et al.
2006/0055087 A1 3/2006 Freund et al.
2009/0039562 A1 2/2009 Freund et al.
2009/0272874 A1 11/2009 Appleby et al.

* cited by examiner

*Primary Examiner* — Jurie Yun
(74) *Attorney, Agent, or Firm* — Joseph J. Christian

(57) ABSTRACT

A method of making an anti-scatter X-ray grid device, and the X-ray grid device made therefrom, includes providing a substrate made of a material substantially non-absorbent of X-rays that includes channels therein; applying a layer, also of a substantially non-absorbent of X-rays material, onto a sidewall(s) of the channels, wherein the layer comprises a second material; and then applying a material substantially absorbent of X-rays into a portion of the channels, so as to define a plurality of X-ray absorbing elements. The present invention has been described in terms of specific embodiment (s), and it is recognized that equivalents, alternatives, and modifications, aside from those expressly stated, are possible and within the scope of the appending claims.

18 Claims, 3 Drawing Sheets

ANTI-SCATTER X-RAY GRID DEVICE AND METHOD OF MAKING SAME

BACKGROUND OF THE INVENTION

The present invention relates generally to the field of diagnostic radiography and, more particularly, to an anti-scatter X-ray grid device and a method of making the same.

Anti-scatter grids are widely used in X-ray imaging to enhance image quality. X-rays emitted from a point source pass through a patient or object and are then detected in a suitable X-ray detector. X-ray imaging works by detecting the intensity of X-rays as a function of position across the X-ray detector. Darker areas with less intensity correspond to regions of higher density or thickness in the object, while lighter areas with greater intensity correspond to areas of lower density or thickness in the object. This method relies on X-rays either passing directly through the object or being totally absorbed. However, X-rays may also undergo scattering processes, primarily Compton scattering, in the patient or object. Such X-rays generate image noise and thus reduce the quality of the image. In order to lessen the impact of such scattered X-rays, an anti-scatter grid is employed. The grid preferentially passes primary X-rays (those that do not scatter) and rejects scattered X-rays. This is done by interleaving materials of low X-ray absorption, such as graphite or aluminum, with layers of high X-ray absorption, such as lead or tungsten. Scattered X-rays are then preferentially stopped before entering the X-ray detector. However, a fraction of primary X-rays are also absorbed in the grid.

One of the primary metrics for anti-scatter grid performance is the quantum improvement factor (QIF), wherein $QIF=T_p^2/T_t$. $T_p$ is the primary X-ray transmission through the grid and $T_t$ is the total transmission. This equation shows the importance of achieving a high primary transmission. If primary X-rays are lost, imaging information is also lost and thus either the X-ray dose must be increased or a degradation in image quality accepted. A QIF of 1 or greater indicates an improvement in image quality, while a QIF of <1 indicates that the grid actually harms the quality of the image.

The principal design metrics for an anti-scatter grid are the line frequency, the line thickness, and the grid height, often expressed as the ratio. The line frequency, typically expressed in units of lines/cm, gives the number of absorbing strips of material in a given distance. The line thickness is just the thickness of the absorbing lines, often expressed in units of microns. The grid ratio is the ratio of the grid height to the interspace distance (the amount of low-absorbing material between a pair of grid lines). Grid performance is also influenced by the material used in manufacturing the grid and the type and thickness of grid covers, which are non-active sheets encasing the grid to provide mechanical support.

In designing an anti-scatter grid, the degree of scatter rejection must be balanced with the primary transmission in order to maximize the quantum improvement factor. However, this is not always possible because of manufacturing limitations. For example, in a low-energy procedure, such as mammography, the grid lines are often thicker than required because of limitations in manufacturing grids with very thin lines. Moreover, in such low energy procedures, the interspace material can be a significant absorber of primary X-rays.

Traditional methods of grid manufacture involve laminating lead foils onto interspace material or using a fine saw to cut grooves in a graphite substrate and filling the grooves with lead. Molding has also been suggested as a method of grid manufacture, for example as disclosed in U.S. Patent Publication Number US20090272874.

Accordingly, there is an ongoing need for improving upon existing X-ray grid design and manufacturing techniques.

BRIEF DESCRIPTION

The present invention overcomes at least some of the aforementioned drawbacks by providing an anti-scatter X-ray grid device, and a method of making an anti-scatter X-ray grid device, that ultimately provides improved grid performance. More specifically, the present invention is directed to a grid manufacturing technique that provides grids with extremely thin grid lines, and highly transparent interspace material, that is fast, inexpensive and highly repeatable.

Therefore, in accordance with one aspect of the invention, a method of making an anti-scatter X-ray grid device comprises: providing a substrate comprising a first material substantially non-absorbent of X-rays, the substrate having a plurality of channels therein; applying a layer onto a sidewall of the plurality of channels, wherein the layer comprises a second material substantially non-absorbent of X-rays; and applying a third material substantially absorbent of X-rays into a portion of the plurality of channels, thereby defining a plurality of X-ray absorbing elements.

In accordance with another aspect of the invention, an anti-scatter X-ray grid device comprises: a substrate comprising a first material substantially non-absorbent of X-rays, the substrate having a plurality of channels therein; a second material substantially non-absorbent of X-rays, lining sidewalls of the plurality of channels; and a third material substantially absorbent of X-rays, at least partially resident in the plurality of channels, thereby defining a plurality of X-ray absorbing elements.

Various other features and advantages of the present invention will be made apparent from the following detailed description and the drawings.

BRIEF DESCRIPTION OF THE DRAWINGS

The drawings illustrate one embodiment presently contemplated for carrying out the invention.

DETAILED DESCRIPTION

Aspects of the present invention have been shown to offer advantages over previous methodologies of making anti-scatter X-ray grid devices. Aspects of the present invention provide a manufacturing technique that allows for thinner grid lines and highly X-ray transparent interspace material in a cost effective and well-controlled process. Amongst other advantages, use of grid devices 10 employing the present invention will provide for better imaging results for mammographic and other low energy (e.g., about 26-33 kVp) X-ray systems.

Figure 1:
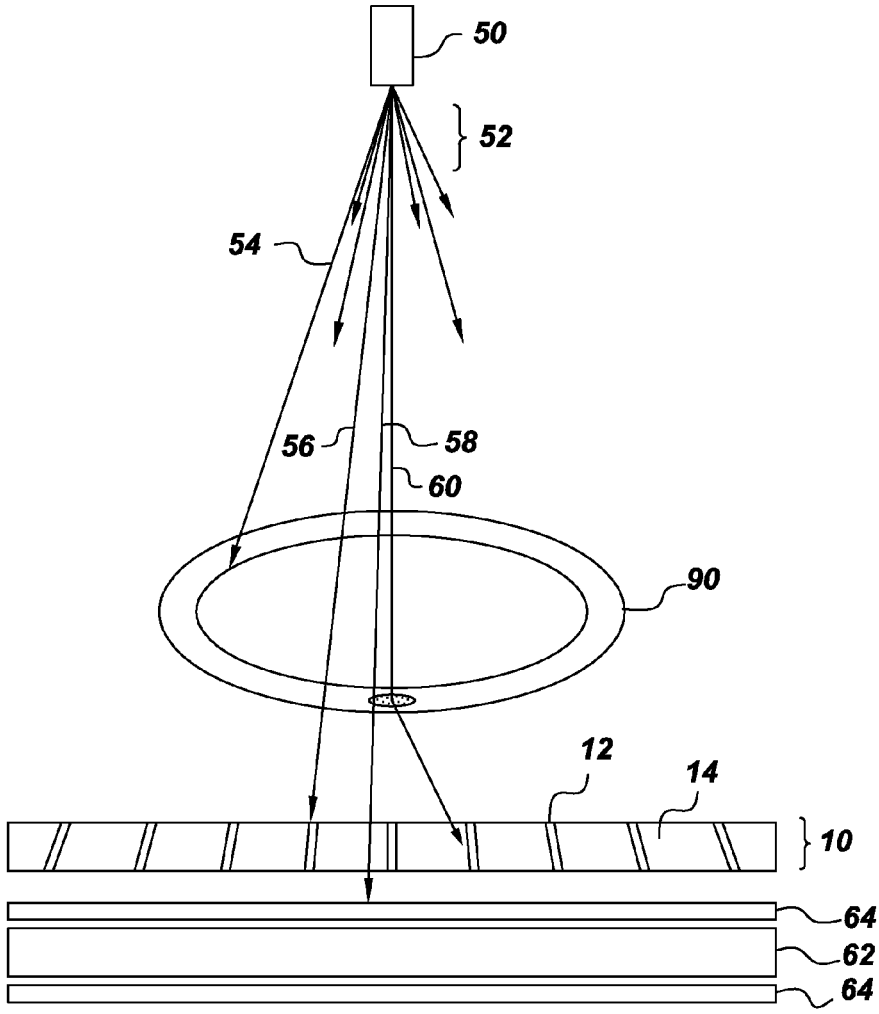
FIG. 1 is a sectional elevation view of a radiographic imaging system incorporating aspects of the present invention.

FIG. 1 is a sectional side view of a conventional radiographic imaging arrangement employing an embodiment of the present invention. A tube 50 generates and emits x-radiation 52 which travels toward a body 90. Some of the x-radiation 54 is absorbed by the body 90 while some of the radiation penetrates and travels along paths 56 and 58 as primary radiation, and other radiation is deflected and travels along path 60 as scattered radiation.

Radiation from paths 56, 58, and 60 travels toward an image receptor such as photosensitive film 62 where it will become absorbed by intensifying screens 64 which are coated with a photosensitive material that fluoresces at a wavelength of visible light and thus exposes photosensitive film 62 (the radiograph) with the latent image.

When an anti-scatter grid 10 is interposed between body 90 and photosensitive film 62, radiation paths 56, 58, and 60 travel toward the anti-scatter grid 10 before film 62. Radiation path 58 travels through translucent material 14 of the grid 10, whereas both radiation paths 56 and 60 impinge upon absorbing material 12 and become absorbed. The absorption of radiation path 60 constitutes the elimination of the scattered radiation. The absorption of radiation path 56 constitutes the elimination of part of the primary radiation. Radiation path 58, the remainder of the primary radiation, travels toward the photosensitive film 62 and becomes absorbed by the intensifying photosensitive screens 64 which expose photosensitive film 62 with the latent image.

While the configuration shown in FIG. 1 contemplates a film-based detection system, other image receptors may be used without departing from the present invention. For example, the image receiving portion of the system may instead comprise a digital system using either direct or indirect conversion methods. In the indirect method, the X-rays would be absorbed in a scintillator layer which emits visible light that is subsequently detected in an array of photodiodes. In the direct method, the X-rays would be converted directly into an electrical signal in a suitable direct conversion material, such as amorphous selenium.

Figure 2:
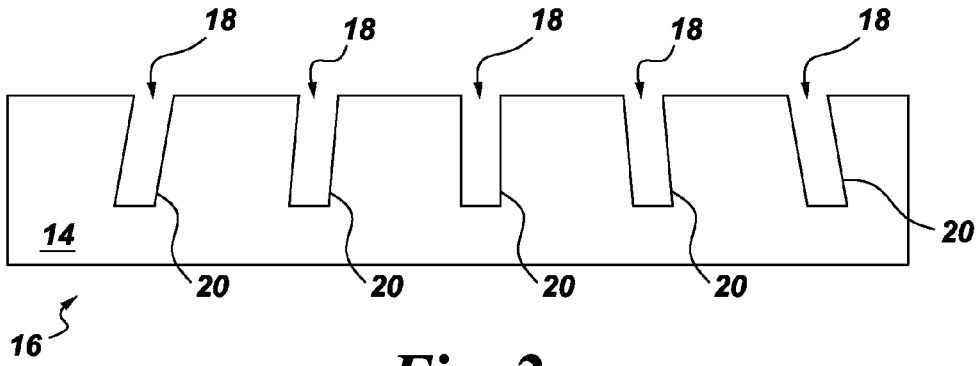
FIG. 2 is a sectional elevation view of a portion of an anti-scatter X-ray grid device being made according to aspects of the present invention.

Referring to FIG. 2, a sectional elevation view of a portion 16 of an anti-scatter X-ray grid device is shown. An embodiment of a method of making a grid may start with providing this portion 16. The portion 16 comprises a substrate 14 having a plurality of channels 18 therein. The substrate 14 may be made of a first material that is substantially non-absorbent of X-rays. As shown, the plurality of channels 18 may include sidewalls 20 and a channel bottom or end.

The plurality of channels 18 may be made by a variety of techniques. For example, the plurality of channels 18 may be made in the substrate 14 by at least one of injection molding, laser, mechanical, plasma etching, and the like. The substrate 14 may be made of any suitable material that is substantially non-absorbent of X-rays such as thermoplastic, PEEK, graphite, aluminum, and combinations thereof.

As shown for example in FIGS. 1 and 2, the axial orientation of the plurality of channels 18 may be non-parallel so the cone of X-rays emitted from the source 50 (FIG. 1) approximately align with the axes of the plurality of channels 18.

While FIG. 2 shows a substrate 14 portion of an embodiment of an anti-scatter grid, clearly there are other embodiments available without departing from aspects of the invention. For example, while only five channels 18 are shown, the totally quantity of channels 18 may be virtually any suitable number. Similarly, the cross sectional shape, dimensions, and configuration can vary from that shown.

Figure 3:
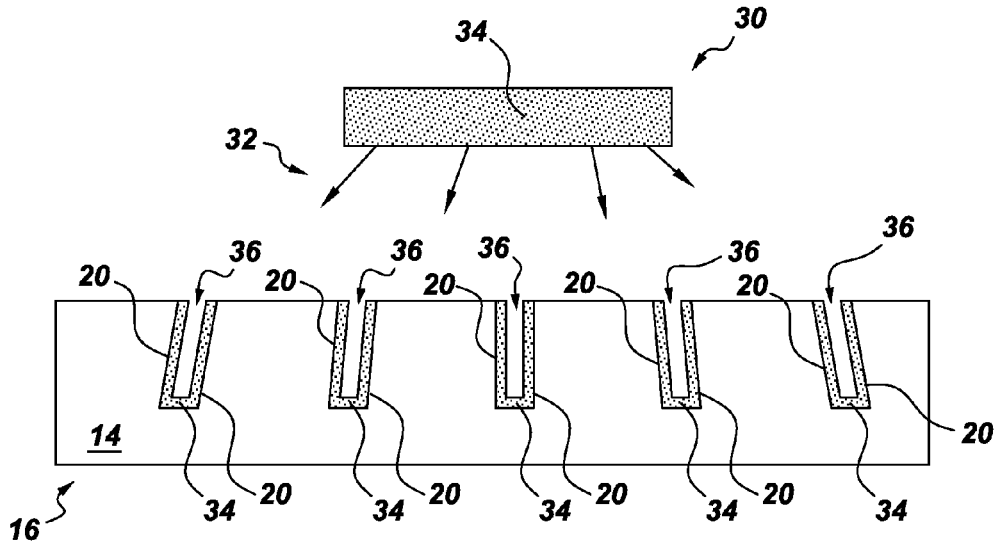
FIG. 3 is a sectional elevation view of the portion of an anti-scatter X-ray grid device from FIG. 2 being further made according to aspects of the present invention.

Referring to FIG. 3, a sectional elevation view of the portion 16 of an anti-scatter X-ray grid device is shown undergoing a second step in a method of making the grid device. As shown, a second material 34 substantially non-absorbent to X-rays is placed within the plurality of channels 18. The second material 34 may be provided via a reservoir or source 30 so that the second material 34 may be applied 32 as a layer onto the sidewalls 20 of the plurality of channels 18. For example, the second material 34 may be any suitable conformal coating that may be applied via a variety of suitable methods including at least one of vacuum deposition, evaporation, chemical vapor deposition, sputtering, and the like. Similarly, the conformal coating comprises an oxide, a nitride, a polymer, an acrylic, an epoxy, a urethane, silicone, and combinations thereof. In an embodiment, the conformal coating may comprise Parylene. Parylene is a tradename for a variety of chemical vapor deposited poly (p-xylylene) polymers. As shown, any suitable material may be used as the second material 34 that both narrows the width of the plurality of channels 18 and does not fully fill the width of the plurality of channels 18. In this manner, the application of the second material 34 provides for a remaining channel 36.

While FIG. 3 shows the substrate 14 portion of an embodiment of an anti-scatter grid undergoing an application of the second material 34, clearly there are other embodiments available without departing from aspects of the invention. For example, the second material 34 may be applied as a layer on only one of the two sidewalls 20 and ends or bottoms of the plurality of channels 18. Suitable quantities of the second material 34 may be applied in the plurality of channels 18 so that a width of the remaining channels 36 is less than about 20 μm. In other embodiments, the width of the remaining channels 36 may be in a range from about 5 μm to about 10 μm.

Figure 4:
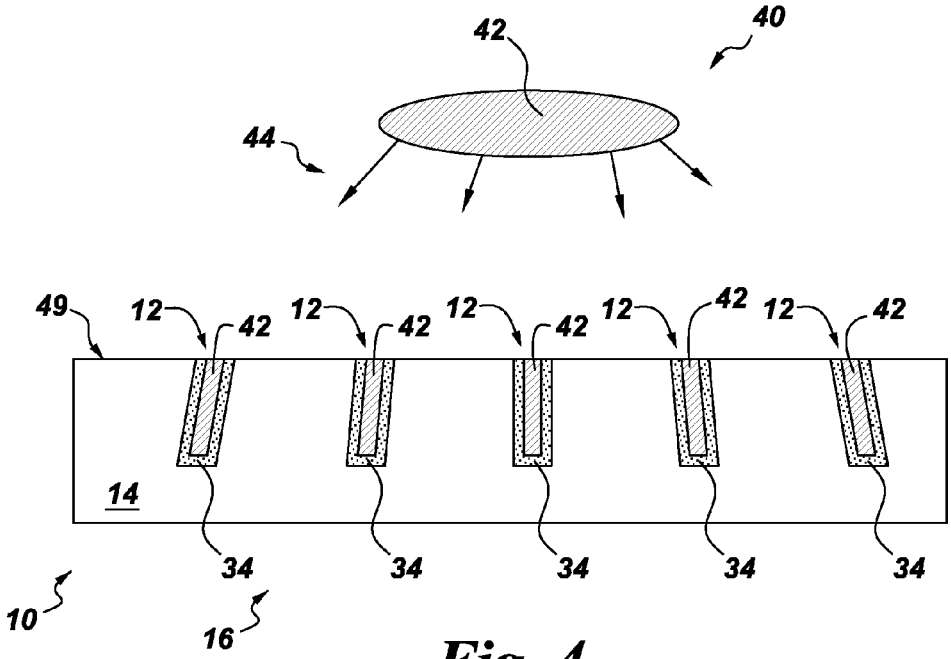
FIG. 4 is a sectional elevation view of the portion of an anti-scatter X-ray grid device from FIG. 3 being further made according to aspects of the present invention.

Referring to FIG. 4, a sectional elevation view of the portion 16 of an anti-scatter X-ray grid device is shown undergoing a third step in a method of making the grid device 10. As shown, a third material 42 substantially absorbent to X-rays is applied within a portion of the remaining channels 36, thereby defining a grid device 10. The third material 42 may be provided via a reservoir or source 40 such that the third material 42 may be applied 44 into a portion of the remaining channels 36 thereby defining a plurality of X-ray absorbing elements 12. The third material 42 may be any suitable material that is substantially absorbent of X-rays such as a material that contains lead, tungsten, uranium, gold, and/or a polymer (e.g., epoxy, etc.) containing lead, tungsten, and/or gold. As shown, the third material 42 may be applied in the remaining channels 36 so that the third material 42 substantially fills the plurality of channels 18. In this manner, the application of the third material 42 ultimately defines a plurality of X-ray absorbing elements 12 that may have an angular orientation (see e.g., FIGS. 1 and 5). In an embodiment, a top surface 49 of the grid device 10 may be planarized by any suitable means including, for example, mechanical grinding and the like.

Figure 5:
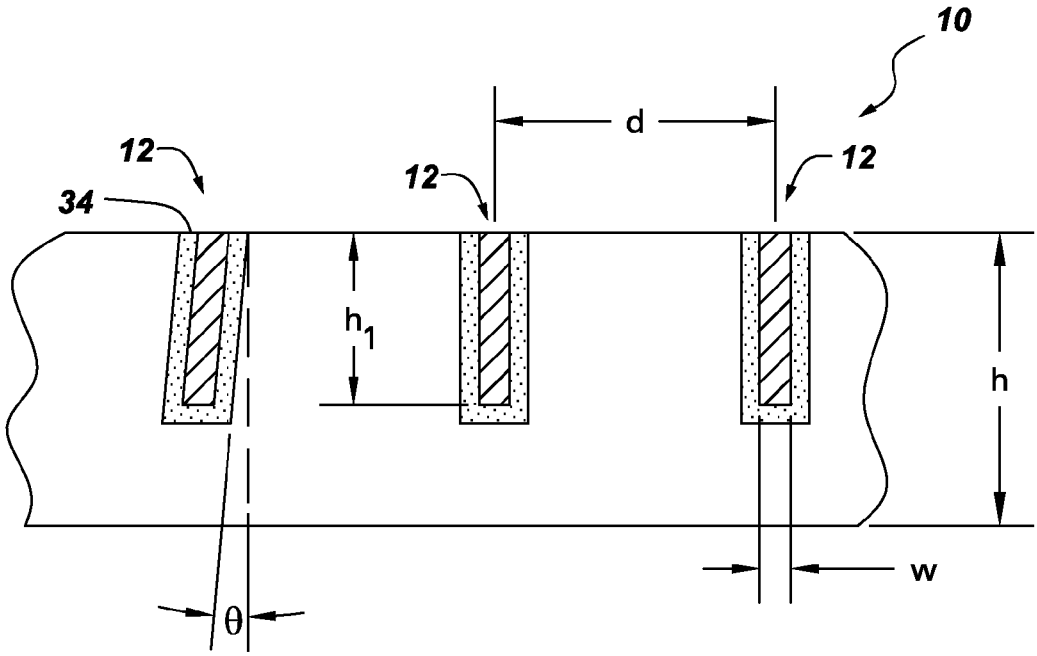
FIG. 5 is a sectional elevation view of a completed portion of an anti-scatter X-ray grid device according to aspects of the present invention.

As FIG. 5 shows, a portion of the grid device 10 may be constructed employing aspects of the methods disclosed herein. The grid device 10 includes a plurality of X-ray absorbing elements 12 having a width, w, and height, $h_1$ that are distributed a space, d, apart. The height of the grid device 10, denoted as h, is generally greater than $h_1$ and may be about 1 mm or any other suitable height. Similarly, $h_1$ may be partially through the height of the grid device, and be, for example, 0.5 mm. The width, w, of the plurality of X-ray absorbing elements 12 may be in a range of about 20 μm to about 30 μm. In other embodiments, the width, w, of the plurality of X-ray absorbing elements 12 may be in a range of about 5 μm to about 10 μm. Similarly, the spacing, d, between adjacent X-ray absorbing elements 12 may be in a range of about 100 μm to about 300 μm. The X-ray absorbing elements 12 are located within X-ray non-absorbent materials comprising the substrate 14 and second material 34. The footprint of the completed grid device 10 may be virtually any suitable size. For example, the grid device 10 may be a rectangle having dimensions (i.e., length and/or width) that are in a range from about 12 cm to at least about 40 cm. Similarly, the distribution of the plurality of channels 18, and concomitantly the plurality of elements 12, may be in a range from about 30 elements/cm to about 100 elements/cm.

As shown in FIG. 5 and FIG. 1, for example, the plurality of X-ray absorbing elements 12 may have an angular orientation. That is a longitudinal axis of each the plurality of X-ray absorbing elements 12 may vary from being normal to the X-ray source 50 (FIG. 1) by an offset angle, θ. As shown in FIG. 1, the offset angle, θ, may vary and increase in the various plurality of X-ray absorbing elements 12, from 0 degrees to any suitable angle (e.g., 15 degrees, etc.). The location within the grid device 10 of the X-ray absorbing elements 12 that have various offset angles can vary depending on the geometry of the X-ray system. For example, in an embodiment, the center of the grid device 10 may include X-ray absorbing elements 12 that are about 0 degrees. In another embodiment (e.g., mammographic systems), at least one of the edge regions of the grid device 10 may include X-ray absorbing elements 12 that are about 0 degrees. The precise angular orientation of the various X-ray absorbing elements 12 may depend on the location and distance of the X-ray source(s). In this manner, the grid device 10 is a focused grid.

Therefore, according to one embodiment of the present invention, a method of making an anti-scatter X-ray grid device comprises: providing a substrate comprising a first material substantially non-absorbent of X-rays, the substrate having a plurality of channels therein; applying a layer onto a sidewall of the plurality of channels, wherein the layer comprises a second material substantially non-absorbent of X-rays; and applying a third material substantially absorbent of X-rays into a portion of the plurality of channels, thereby defining a plurality of X-ray absorbing elements.

According to another embodiment of the present invention, an anti-scatter X-ray grid device comprises: a substrate comprising a first material substantially non-absorbent of X-rays, the substrate having a plurality of channels therein; a second material substantially non-absorbent of X-rays, lining sidewalls of the plurality of channels; and a third material substantially absorbent of X-rays, at least partially resident in the plurality of channels, thereby defining a plurality of X-ray absorbing elements.

The present invention has been described in terms of the preferred embodiment, and it is recognized that equivalents, alternatives, and modifications, aside from those expressly stated, are possible and within the scope of the appending claims.

What is claimed is:

1. A method of making an anti-scatter X-ray grid device comprising:

providing a substrate comprising a first material substantially non-absorbent of X-rays, the substrate having a plurality of channels therein;

applying a layer onto a sidewall of the plurality of channels, wherein the layer comprises a second material substantially non-absorbent of X-rays; and applying a third material substantially absorbent of X-rays into a portion of the plurality of channels, thereby defining a plurality of X-ray absorbing elements.

2. The method of claim 1 wherein the second material is a conformal coating.

3. The method of claim 1 wherein the third material comprises at least one of lead, tungsten, uranium, gold, a polymer containing lead, a polymer containing tungsten, and a polymer containing gold.

4. The method of claim 1, wherein a length or width of the anti-scatter X-ray grid device is in a range from about 12 cm to about 40 cm.

5. The method of claim 1, wherein a width of the plurality of X-ray absorbing elements is less than about 20 μm.

6. The method of claim 1, wherein a width of the plurality of X-ray absorbing elements is in a range from about 5 μm to about 10 μm.

7. The method of claim 1, wherein the applying a layer comprises applying a conformal coating in the plurality of channels.

8. The method of claim 7, wherein the conformal coating comprises an oxide, a nitride, a plastic, a polymer, an acrylic, an epoxy, a urethane, silicone, and combinations thereof.

9. The method of claim 7, wherein the conformal coating comprises Parylene.

10. The method of claim 1, wherein the plurality of X-ray absorbing elements are configured in an angular orientation.

11. The method of claim 1, further comprising prior to providing a substrate, making the plurality of channels in the substrate by at least one of injection molding, laser, mechanical removal, and plasma etching.

12. The method of claim 1, wherein the applying a layer comprises applying a layer on both sidewalls of the plurality of channels.

13. The method of claim 12, wherein the applying a layer comprises applying a conformal coating to a surface of the plurality of channels.

14. The method of claim 13, wherein the conformal coating is applied by one of vacuum deposition, evaporation, chemical vapor deposition, and sputtering.

15. The method of claim 1, wherein the applying a third material comprises filling the plurality of channels.

16. The method of claim 1, further comprising planarizing a top surface of the grid device.

17. An anti-scatter X-ray grid device comprising:

a substrate comprising a first material substantially non-absorbent of X-rays, the substrate having a plurality of channels therein;

a second material substantially non-absorbent of X-rays, lining sidewalls of the plurality of channels; and a third material substantially absorbent of X-rays, at least partially resident in the plurality of channels, thereby defining a plurality of X-ray absorbing elements.

18. The anti-scatter X-ray grid device of claim 17, wherein a width of the plurality of X-ray absorbing elements is less than about 20 μm.

* * * * *